US009033211B2

(12) United States Patent
Zanini

(10) Patent No.: US 9,033,211 B2
(45) Date of Patent: May 19, 2015

(54) CONTAINER FOR FOOD AND/OR DRINK TO BE CONSUMED ON THE MOVE AND METHOD FOR MAKING IT

(75) Inventor: Roberto Zanini, Verona (IT)

(73) Assignee: ZANINI RISTORAZIONE S.R.L., Verona (IT)

( * ) Notice: Subject to any disclaimer, the term of this patent is extended or adjusted under 35 U.S.C. 154(b) by 0 days.

(21) Appl. No.: 14/001,445

(22) PCT Filed: Feb. 28, 2012

(86) PCT No.: PCT/IB2012/050910

§ 371 (c)(1),
(2), (4) Date: Aug. 23, 2013

(87) PCT Pub. No.: WO2012/120406

PCT Pub. Date: Sep. 13, 2012

(65) Prior Publication Data

US 2013/0334294 A1 Dec. 19, 2013

(30) Foreign Application Priority Data

Mar. 9, 2011 (IT) ..... VR2011A0048
Jul. 6, 2011 (IT) ..... VR2011A0137

(51) Int. Cl.

| | |
|---|---|
| ***B65D 5/42*** | (2006.01) |
| ***A47G 19/06*** | (2006.01) |
| ***B65D 5/02*** | (2006.01) |
| ***B65D 5/52*** | (2006.01) |

(52) U.S. Cl.

CPC *B65D 5/42* (2013.01); *A47G 19/06* (2013.01); *B65D 5/029* (2013.01); *B65D 5/4208* (2013.01); *B65D 5/5266* (2013.01); *B65D 5/528* (2013.01)

(58) Field of Classification Search

CPC ..... B65D 5/42; B65D 5/528; B65D 5/4208; B65D 5/5266; B65D 5/029; A47G 19/06
USPC ..... 229/120.15, 120.21, 122, 902, 904, 906
See application file for complete search history.

(56) References Cited

U.S. PATENT DOCUMENTS

| | | | | | |
|---|---|---|---|---|---|
| 2,006,696 | A | * | 7/1935 | Koeble | 229/122 |
| 3,133,634 | A | * | 5/1964 | Bulovic | 206/216 |
| 3,637,130 | A | * | 1/1972 | Farquhar | 229/904 |
| 4,491,220 | A | * | 1/1985 | Daviss | 206/217 |
| 5,184,750 | A | | 2/1993 | Moller | |
| 5,464,150 | A | * | 11/1995 | Porres Sanchez et al. | 229/904 |
| 5,516,039 | A | * | 5/1996 | Kirchhoff | 229/120.15 |
| 5,573,131 | A | | 11/1996 | Berjis | |
| 5,725,117 | A | | 3/1998 | Berjis | |

(Continued)

*Primary Examiner* — Gary Elkins
(74) *Attorney, Agent, or Firm* — Pearne & Gordon LLP

(57) ABSTRACT

A container for food and/or drink to be consumed on the move comprises a first portion (24) forming at least a first holder (3) for containing at least one food to be consumed on the move or for a first receptacle containing a food or a drink to be consumed on the move, and at least a second portion (25) connected to the first portion (24) and forming at least a second holder (4) for supporting a second receptacle containing at least one food or a drink to be consumed on the move. The first holder (3) and the second holder (4) are vertically aligned and they are distanced from each other in such a way as to allow the user independent access both to the first holder (3) and to the second holder (4). For that purpose, at least a third, connecting portion (28) is fixed to the first portion (24) and to the second portion (25) and forms at least one opening (29) for access from above to the lower holder. A method for making a container of this type is also claimed.

22 Claims, 9 Drawing Sheets

(56) References Cited

U.S. PATENT DOCUMENTS

| | | | | |
|---|---|---|---|---|
| 6,060,097 | A | 5/2000 | Grigoryan | |
| 6,119,930 | A * | 9/2000 | Lunstra et al. | 229/906 |
| 7,182,242 | B2 * | 2/2007 | Cai | 206/217 |
| 7,453,869 | B1 | 11/2008 | Paterik | |
| 7,543,869 | B2 | 6/2009 | Davis et al. | |
| 8,172,103 | B2 * | 5/2012 | Spyros et al. | 206/217 |
| 8,365,980 | B2 * | 2/2013 | Wettlaufer et al. | 229/120.15 |
| 2003/0089725 | A1 | 5/2003 | Kang | |
| 2004/0040882 | A1 | 3/2004 | Hemingway et al. | |
| 2004/0084458 | A1 | 5/2004 | Krueger et al. | |
| 2005/0133580 | A1 | 6/2005 | Cai | |
| 2006/0118453 | A1 | 6/2006 | Hillebrecht et al. | |
| 2006/0261075 | A1 | 11/2006 | MacCarthy | |
| 2007/0000927 | A1 * | 1/2007 | Grund et al. | 220/495.03 |
| 2011/0000925 | A1 * | 1/2011 | Okamoto | 220/738 |
| 2013/0171303 | A1 * | 7/2013 | Larsen et al. | 426/120 |

* cited by examiner

CONTAINER FOR FOOD AND/OR DRINK TO BE CONSUMED ON THE MOVE AND METHOD FOR MAKING IT

TECHNICAL FIELD

This invention relates to a container for food and/or drink to be consumed on the move and a method for making it.

BACKGROUND ART

On many occasions in daily life people may find themselves in a situation in which they need to eat and drink while standing or walking. For example, that may happen both in the context of buffets, parties, etc., and in the case of food purchased from fast food outlets but consumed on the move. For example, a person may buy on one hand French fries, and on the other hand a cup or a small bottle containing a drink. This invention is mainly intended for the latter sector.

The problem, in these situations, is that since both hands are full (one with the food and the other with the drink) it is difficult to eat without dropping anything.

For that reason, over the years a series of solutions were developed which allow a person to use one hand to support both the food container and the drink receptacle.

For example, U.S. Pat. No. 7,453,869 describes a complex support which may be used for supporting both a plate and a cup with one hand.

Another example is described in U.S. Pat. No. 6,060,097, in which the top of a tubular container for food is equipped with a holder in which a cup containing a drink can be inserted. The food is removed through an openable door at the bottom of the tubular container.

However, they are solutions which are completely unsuitable for the fast food sector, which requires simple, inexpensive objects which can be thrown away after they have been used.

The most interesting solutions for that sector are those in which the support for the drink itself forms the container for the food.

In a first type of such supports, the cup for the drink and the container for the food form a single body and operate in conjunction with each other. For example, in U.S. Pat. No. 5,725,117 and US 2005/0133580, the container for the food is obtained using a hopper-shaped piece of cardboard which is coupled to the upper part of the cup for the drink, in such a way that the lid of the cup forms the bottom of the container for the food. However, in order to drink, the user must use the straw which passes through the lid of the cup, the food and the food container.

However, this first type of supports is not without disadvantages.

First, the fact that the bottom of the container for the food is formed by the lid of the cup, through which the straw is inserted, means that there is a risk of contaminating the drink with the food. For example, if there are French fries in the container, there is the risk that the salt or sauces may infiltrate the hole made for the straw and reach the drink.

Second, since the lid for the drink is always handled by the sales staff, the fact that it is subsequently placed in contact with the food means that there is a hygiene risk.

Furthermore, if the food is finished before the drink, with that type of support it is not realistically possible to keep only the cup, throwing the rest away, since the lid of the cup and the straw are dirty with food.

Similar problems, although partly reversed, are also found in the case of the solution in patent application US 2003/089725 in which the container for the food forms the lid of the cup.

In contrast, in a further prior art type, whose inventive concept also covers an embodiment of this invention, a single object on one hand forms the container for the food, and on the other hand forms the support for a cup/bottle containing a drink.

Examples of such solutions are described in patent applications US 2006/0261075, US 2004/0084458, US 2004/0040882, US 2006/0118453 and in U.S. Pat. No. 5,184,750.

In all of the prior art solutions, the support extends mainly horizontally and it comprises at least two portions positioned side by side. A first plate/tray-shaped portion is designed to contain the food, and a second portion forms a holder in which the cup can be inserted.

Although more convenient than the previous solutions, these too are not without disadvantages.

The main disadvantage is the fact that said type of supports is not easy to support. In fact, the user must hold the support by one edge, that is to say, with all of the weight projecting cantilever-style. Since the weights in question can easily exceed six/seven hundred grams, supporting them in that projecting fashion for a long period of time may be tiring, since the user must both hold the arm constantly bent at a right angle to keep the support horizontal, and keep gripping with his fingers.

Second, since the weight is off balance relative to the point where the container is gripped, there is always the risk of spilling either the food or the drink.

Third, this type of supports must usually be created by moulding plastic materials, with a negative impact on production costs.

Finally, it should be noticed that there are no prior art containers designed to support two separate receptacles, one containing the food and the other the drink (or both for food or both for a drink).

DISCLOSURE OF THE INVENTION

In this situation the technical purpose which forms the basis of this invention is to provide a container for food and/or drink to be consumed on the move which overcomes the above-mentioned disadvantages.

In particular, the technical purpose of this invention is to provide a container for food and/or drink to be consumed on the move which holds the food and drink separately and which is easier to hold in one's hands than the prior art containers.

A further technical purpose of this invention is to provide a container for food and/or drink to be consumed on the move which is easy to make and inexpensive.

The technical purpose specified and the aims indicated are substantially achieved by a container for food and/or drink to be consumed on the move and a method for making it as described in the appended claims.

BRIEF DESCRIPTION OF THE DRAWINGS

Further features and the advantages of this invention are more apparent in the detailed description, with reference to the accompanying drawings which illustrate several preferred, non-limiting embodiments of a container for food and/or drink to be consumed on the move and of a method for making it, in which.

DETAILED DESCRIPTION OF THE PREFERRED EMBODIMENTS OF THE INVENTION

With reference to the accompanying drawings the numeral 1 denotes in its entirety a container for food and/or drink to be consumed on the move made in accordance with this invention.

It should be noticed that, in the accompanying drawings, the dashed lines indicate, on a flat element, lines along which the material used will subsequently be folded. In fact, in the embodiments illustrated, the entire container 1 is obtained by folding a single rigid or semi-rigid piece of material 2 which extends in such a way that it is mainly flat (advantageously made of cardboard).

Figure 7:
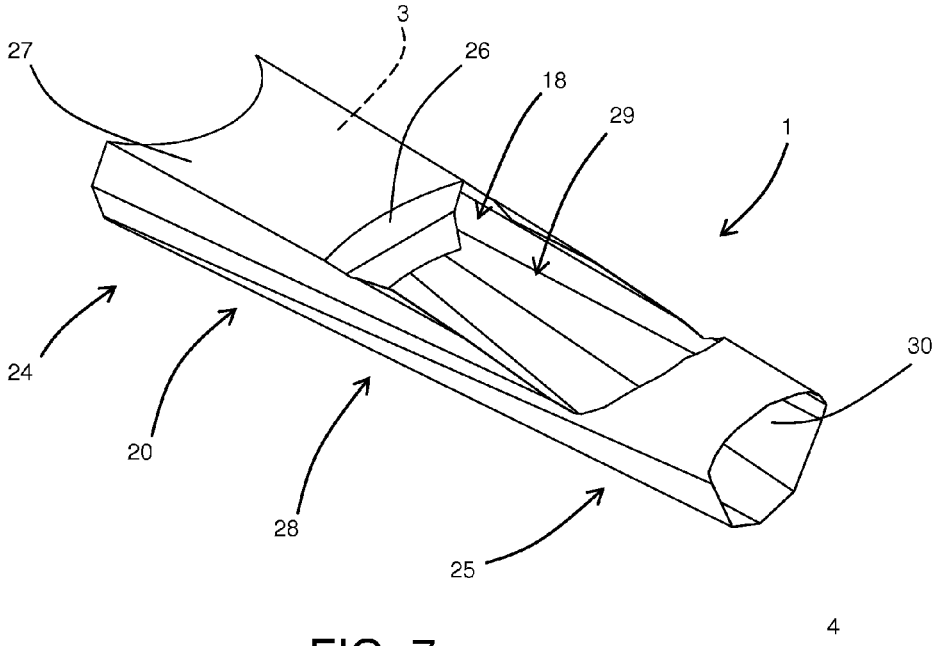
FIG. 7 illustrates the container for food and/or drink to be consumed on the move obtained according to the sequence of steps in FIGS. 1 to 6.
Figure 15:
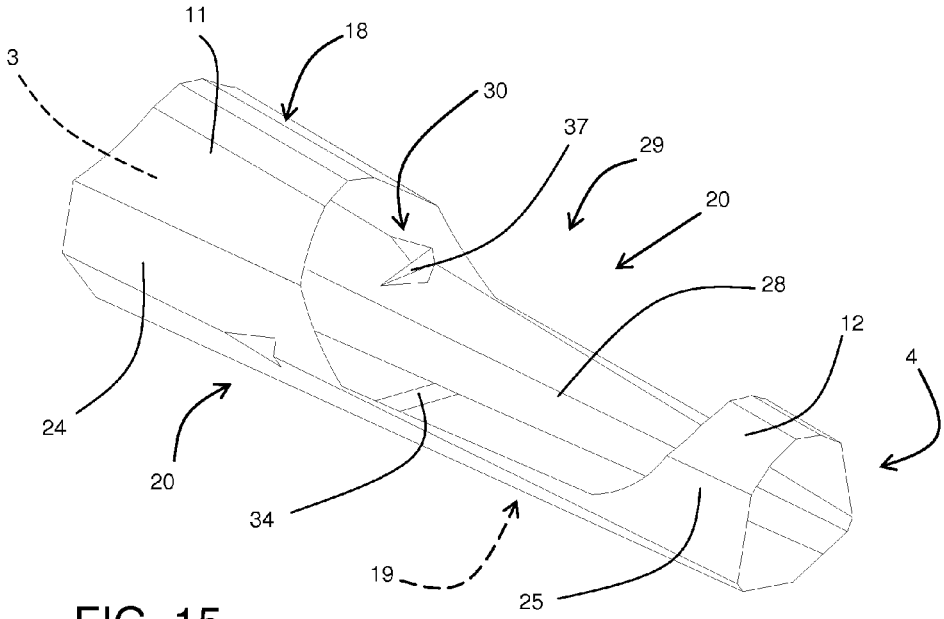
FIG. 15 illustrates the container for food and/or drink to be consumed on the move obtained from the piece of material of FIG. 12.

As shown in FIGS. 7 and 15, according to this invention it is possible to make containers 1 which are substantially of two types: a first type able to hold the food only if it is contained in a receptacle (FIG. 15), and a second type which is instead able to hold the food directly without the need for a receptacle (although, obviously, there is no reason why a receptacle cannot also be used in it).

For the sake of a simple description, hereinafter first a presentation is provided of the preferred methods for making the two types of container 1 according to this invention, and then the more general features of the container 1 are described.

In general, both of the production methods according to this invention are intended to make a container 1 for food and/or drink to be consumed on the move which comprises a first holder 3 for containing at least one food to be consumed on the move or for supporting a first receptacle containing a food or a drink to be consumed on the move, and at least a second holder 4 for supporting a second receptacle containing a food or a drink to be consumed on the move.

Starting with the second type of container 1 indicated above (the one able to directly hold the food), the preferred production method comprises first taking a piece of flat rigid or semi-rigid material 2, for example a piece of food-safe cardboard, mainly having a quadrilateral shape and comprising an upper edge 5, a lower edge 6 and two lateral edges 7. It should be noticed that in the context of this invention, the expression mainly having a quadrilateral shape refers to the rough shape of the piece of material 2, without taking into account any special shaping of each edge 5, 6, 7. Consequently, that definition includes both the flat piece of material 2 of FIG. 1, and that of FIG. 8 (in the rough definition of the shape, the projection 8 projecting outwards from the lower edge 6 can be ignored), as well as that of FIG. 10. In the preferred embodiment, the piece of material 2 has a shape which is substantially symmetrical relative to a plane of symmetry perpendicular to it and passing through the centre of the upper edge 5 and of the lower edge 6.

Figure 1:
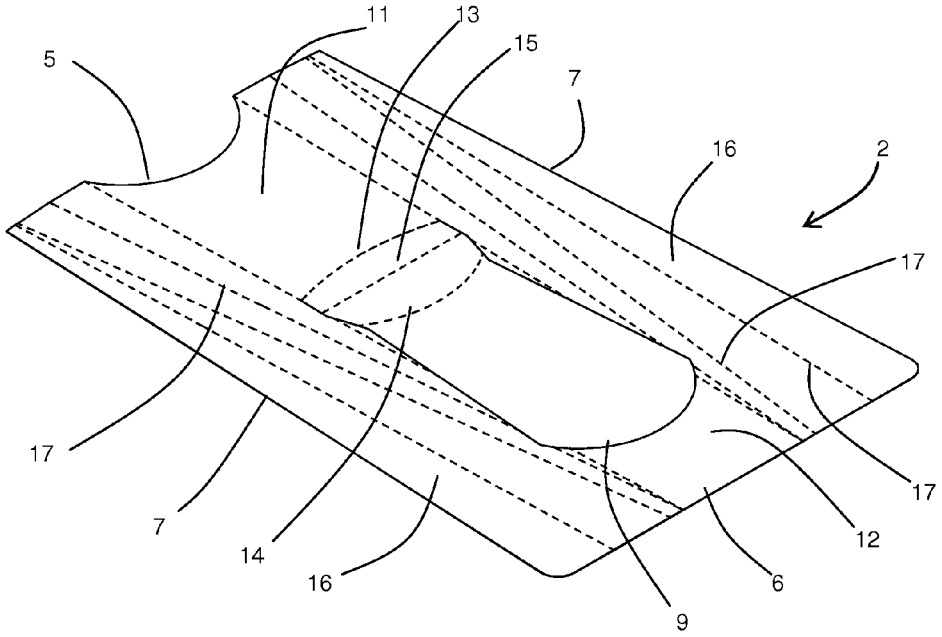
FIG. 1 is an axonometric top view of a piece of material from which a first container according to this invention can be obtained.
Figure 8:
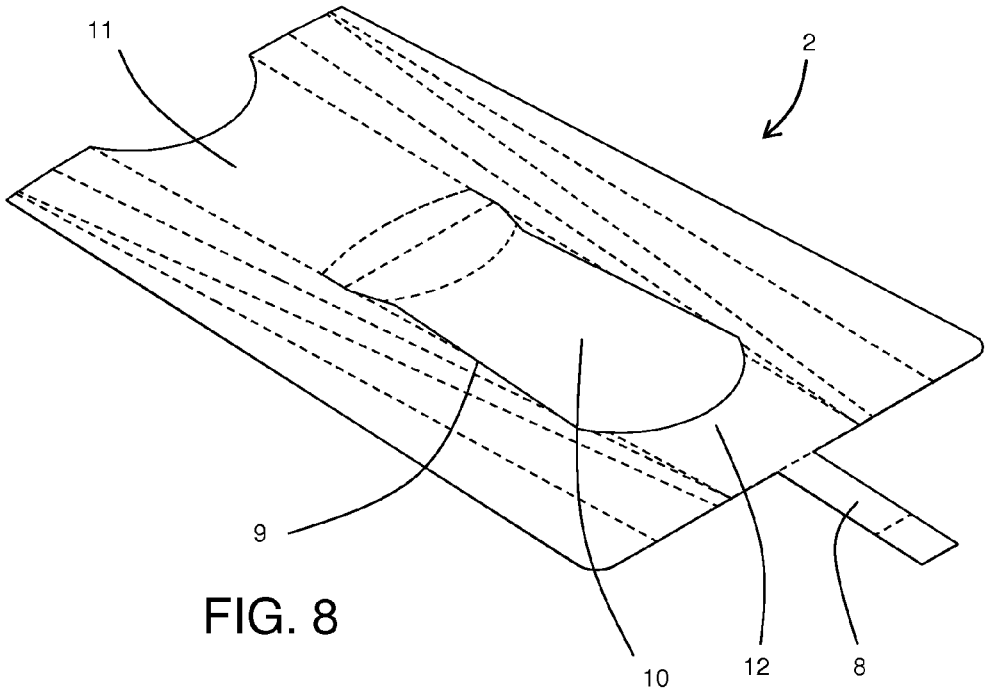
FIG. 8 is a view of a first alternative embodiment of the piece of material of FIG. 1.
Figure 10:
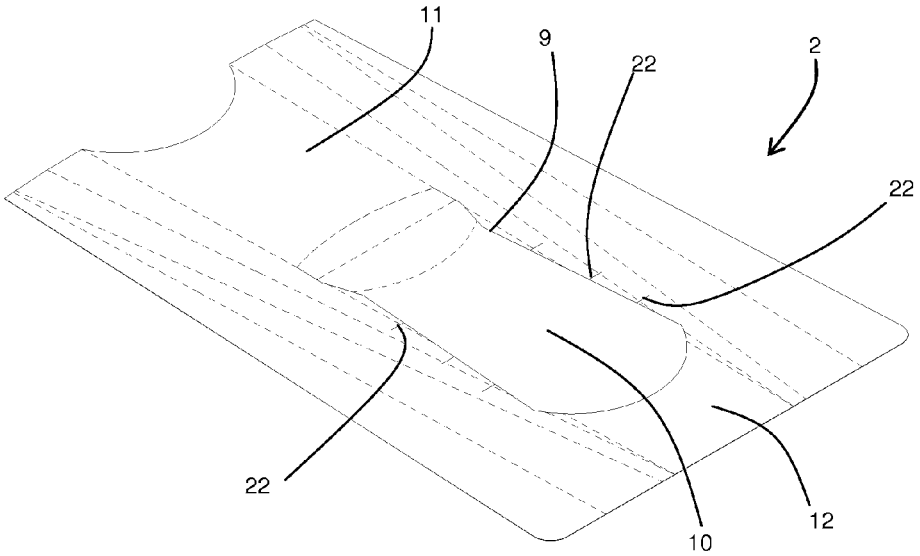
FIG. 10 is a view of a second alternative embodiment of the piece of material of FIG. 1.

However, it should be noticed that the pieces of material illustrated in FIGS. 1, 8 and 10 are pieces of material 2 which have also already undergone the subsequent step of the method according to this invention, of making a mainly U-shaped cut 9 in the piece of material 2 so as to delimit, in the same piece of material 2, a flap of material 10 which is connected to the remaining material at the upper part of the U, and which in contrast is separated from it along the rest of its perimeter, so that it can then be folded as explained in more detail below.

The U-shaped cut 9 is made with an orientation such that the upper part of the U is towards the upper edge 5. Advantageously, in the preferred embodiment, the U is symmetrical relative to the above-mentioned plane of symmetry. The height of the U-shaped flap of material 10 is greater than the height of the band 11 of material which separates it from the upper edge 5. In fact, as explained in more detail below, the height of the flap of material 10 is equal to the sum of the height and depth of the first holder 3 of the container 1 that will be obtained. In contrast, at the bottom, the distance between the flap of material 10 and the lower edge 6 may vary according to requirements. In fact, as explained in more detail below, in the finished container 1, the band 12 of material located between the flap of material 10 and the lower edge 6 forms part of the second holder 4. Finally, regarding the profile of the U, it should be noticed how in the embodiment illustrated it has an irregular trend. In fact, the shape was designed to provide the best possible first holder 3 once the container 1 is finished. However, the profile may vary depending on the embodiment.

Figure 2:
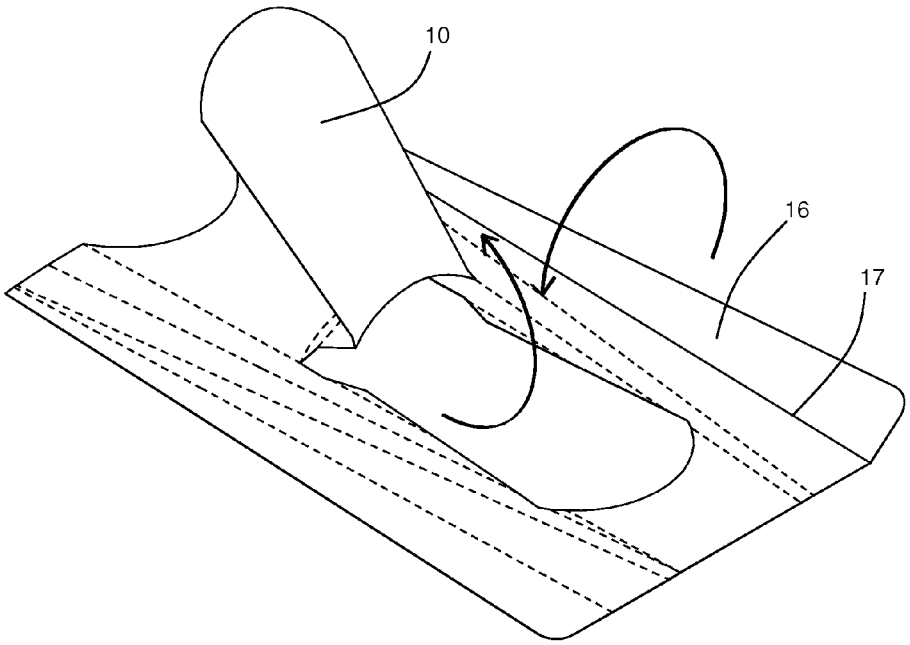
FIGS. 2 to 6 illustrate a sequence of steps for making a container according to this invention starting with the piece of material of FIG. 1.
Figure 3:
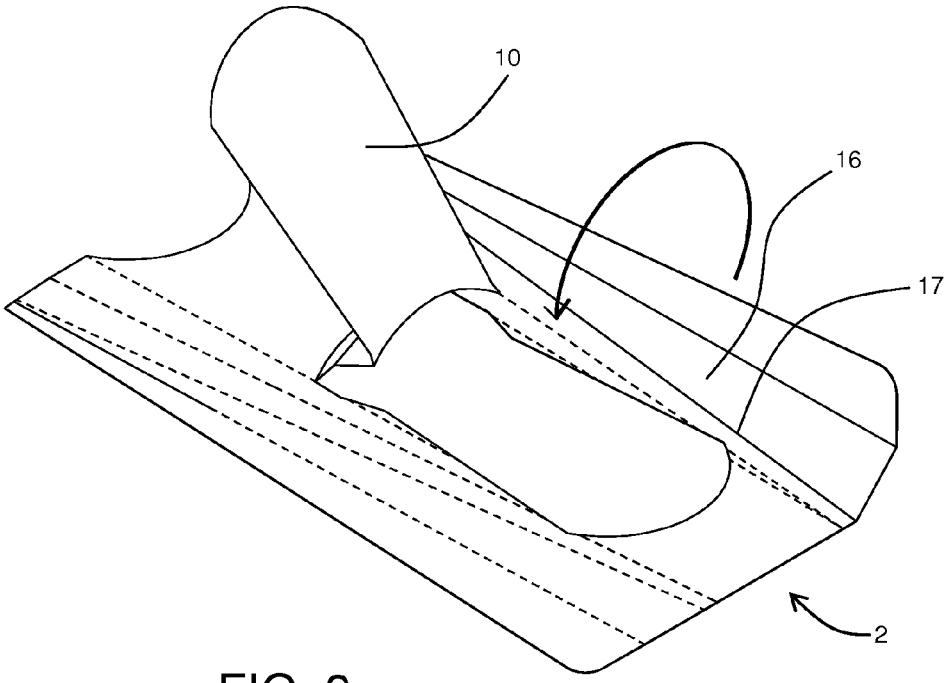
Figure 4:
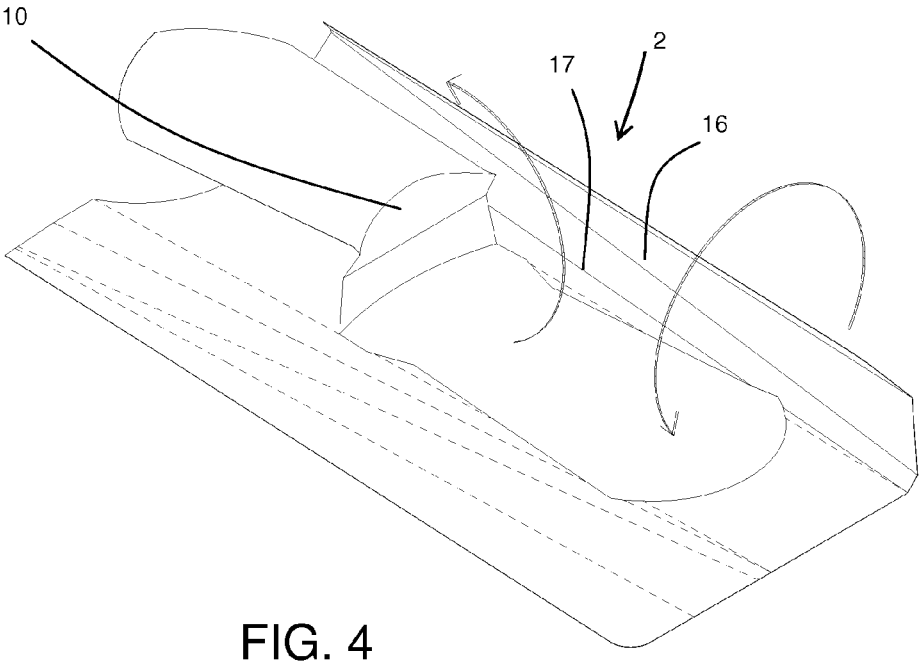

As illustrated in FIGS. 2 to 4, the method comprises folding the flap of material 10 towards the upper edge 5, at least relative to the remaining material. However, in the preferred embodiment the flap of material 10 is also folded over itself. In general, this folding step continues until the flap of material 10 is positioned at least partly substantially opposite the portion of material lying between the flap of material 10 and the upper edge 5, but distanced from it (FIG. 4).

Figure 5:
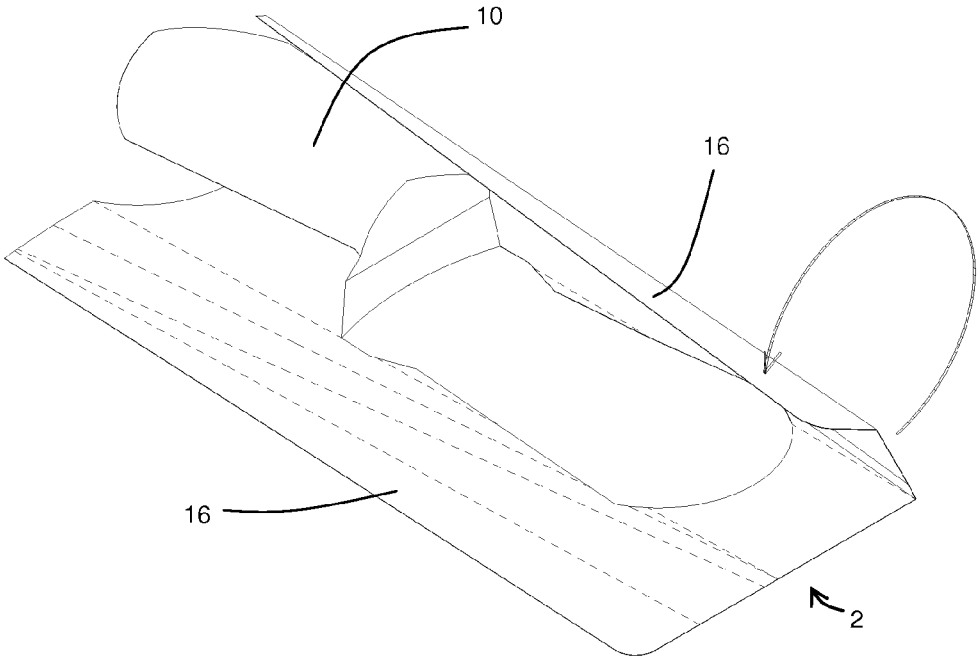

In particular, in the preferred embodiment, the flap of material 10 is on average folded through approximately 90° relative to the remaining material along a first curved transversal fold line 13 which joins the ends of the U, and is also further folded on average through approximately 90° over itself along a second curved fold line 14 located a predetermined distance from the first fold line 13 and with opposite concavity to the latter. To allow correct folding and a correct shape of the bottom of the first holder 3 (formed by the part of the material located between the first fold line 13 and the second fold line 14), there is also an intermediate third fold line 15 between the first two lines which allows the bottom of the first holder 3 to have a shape pointing slightly towards the inside of the holder (FIG. 5).

Figure 6:
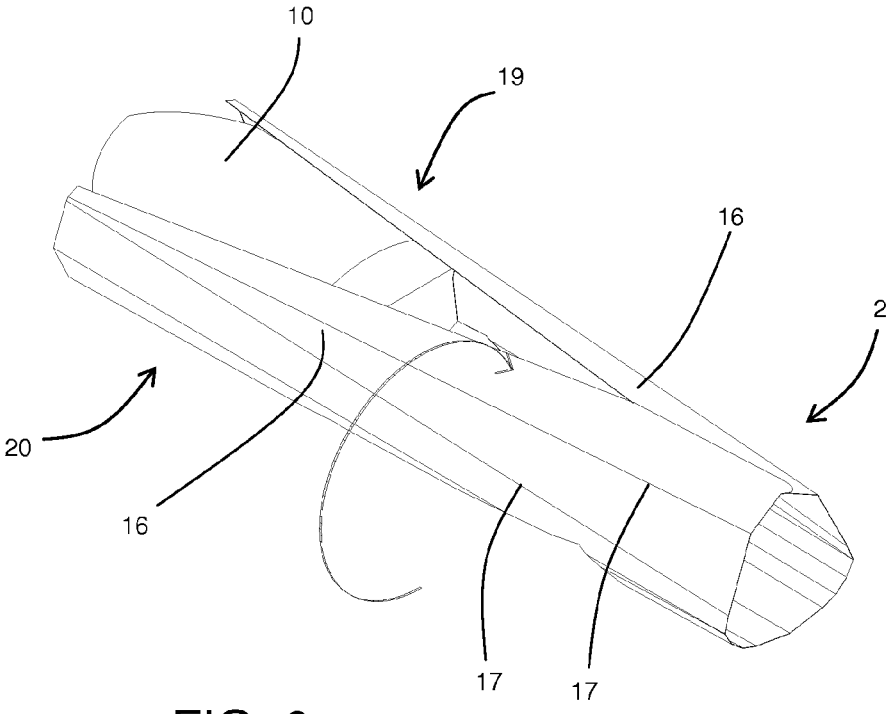

The method also comprises a second folding step during which the lateral portions 16 of material which are adjacent to the lateral edges 7 are folded towards each other (both relative to the rest of the material and over themselves). Each of said lateral portions 16 is folded until it and the folded flap of material 10 are at least partly superposed (in the embodiment illustrated it is the lateral portion 16 which is superposed on the flap of material 10). Moreover, the two lateral portions 16 are folded in such a way that they are superposed one on the other at least at the lower edge 6, as shown in FIG. 6. In the preferred embodiment, the step of folding the lateral portions 16 of material which are adjacent to the lateral edges 7 comprises folding the material more at the lower edge 6 than at the upper edge 5, in such a way that the container 1 has a cross-section decreasing from the upper edge 5 towards the lower edge 6. In other words, when folding is complete, the container 1 has an overall shape which is roughly that of a truncated cone. That is advantageously achieved by means of a plurality of fold lines 17 which are angled relative to the lateral edges 7, in such a way that they converge with each other towards the lower edge 6.

It should be noticed that the time sequence of the various folding steps may vary according to requirements. Moreover, in other embodiments all of the various folds may be obtained not along fold lines, but by simply bending the material.

The final essential step of the method according to this invention comprises fixing the flap of material 10 and the other folded lateral portions 16 in their final positions relative to each other (those illustrated in FIG. 6). While in the embodiment illustrated that is done by gluing, in other embodiments the same result may also be achieved using other methods (for example by slotting or tucking into place suitable elements made in the piece of material 2 in a similar way to that known in the production of three-dimensional objects using folded cardboard, such as making shoe boxes).

Once the container 1 is complete, due to the use which will then be made of it, it comprises not just an upper part and a lower part (respectively corresponding to the upper and lower edges), but also a main front face 18 (shown in FIG. 7), a main rear face 19 (FIG. 6—the face where the various folded parts are superposed) and two lateral secondary faces 20.

With reference to the first type of container 1 indicated above (the one only able to hold food by supporting a related receptacle), again in this case the preferred production method comprises first taking a piece of flat rigid or semi-rigid material 2, for example a piece of cardboard, mainly having a quadrilateral shape and comprising an upper edge 5, a lower edge 6 and two lateral edges 7. It should be noticed that in the context of this invention, the expression mainly having a quadrilateral shape refers to the rough shape of the piece of material 2, without taking into account any special shaping of each edge 5, 6, 7 or any projections applied to it. Consequently, that definition includes the flat piece of material 2 of FIG. 12, and that of FIG. 13, as well as that of FIG. 16 (in the rough definition of the shape, the two parts 32 projecting outwards from the upper edge 5 to form a handle 33 in the finished container 1 can be ignored). In the preferred embodiment, the piece of material 2 has a shape which is substantially symmetrical relative to a plane of symmetry perpendicular to it and passing through the centre of the upper edge 5 and of the lower edge 6.

Figure 12:
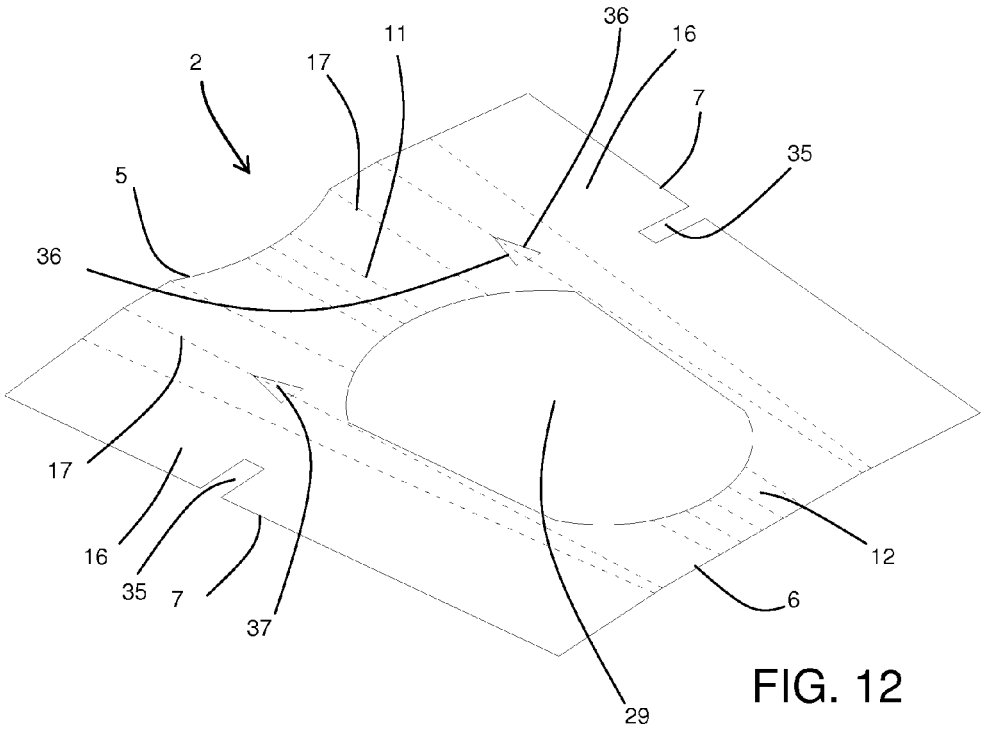
FIG. 12 is an axonometric top view of a further piece of material from which a second container according to this invention can be obtained.
Figure 16:
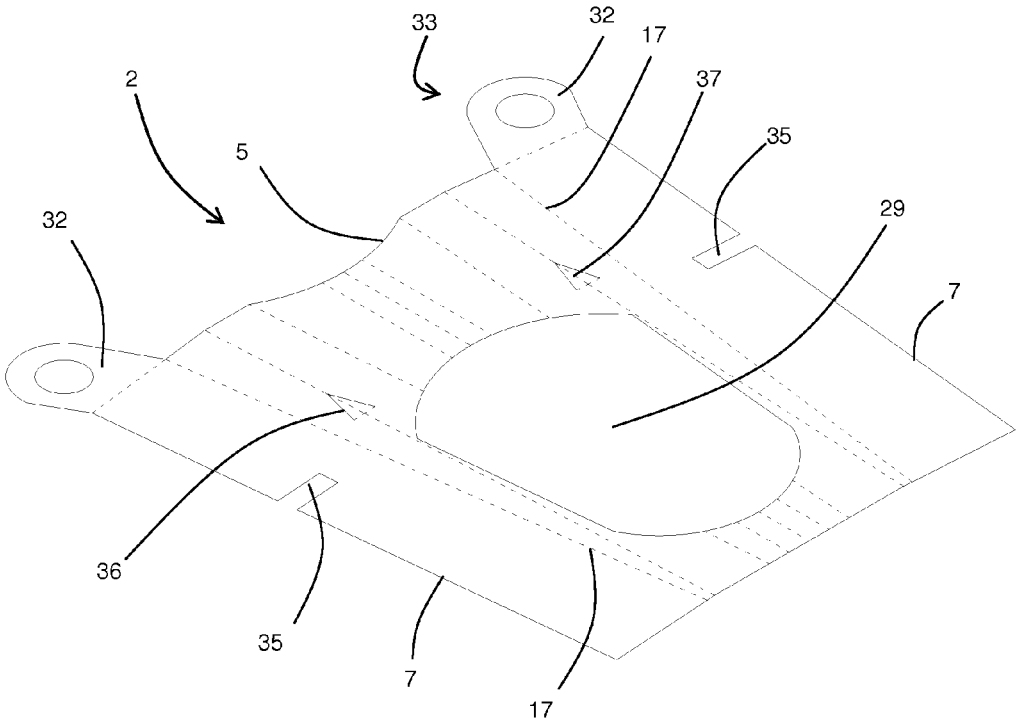
FIG. 16 is a view of an alternative embodiment of the piece of material of FIG. 12.

However, it should be noticed that the pieces of material illustrated in FIGS. 12 and 16 are pieces of material 2 which have also already undergone a further step of the method according to this invention, of making in the piece of material 2 an opening 29 which, in the finished container allows access to the lower holder. Advantageously, in the preferred embodiment, the opening 29 is symmetrical relative to the above-mentioned plane of symmetry, and identifies a band 11 of material which separates it from the upper edge 5 and a band 12 of material which separates it from the lower edge 6. In the finished container the two bands 11 and 12 will respectively form part of the first holder 3 and of the second holder 4.

Figure 13:
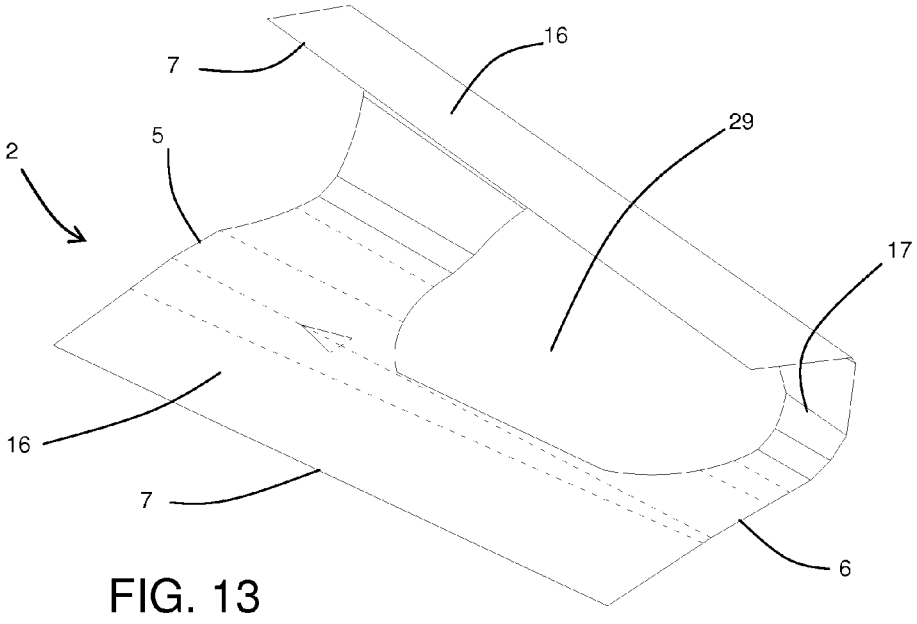
FIG. 13 is an axonometric top view of a first step of folding a piece of material similar to that of FIG. 12 but without two notches.
Figure 14:
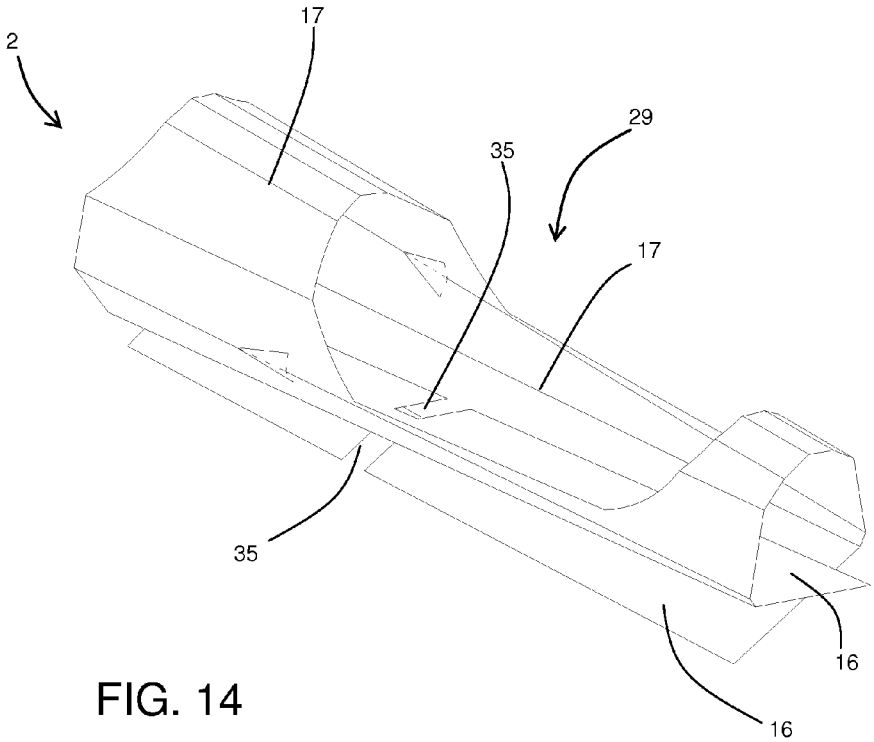
FIG. 14 is a view of a second folding step, after that of FIG. 13, but again relating to the piece of material of FIG. 12.

The method also comprises a folding step during which the lateral portions 16 of material which are adjacent to the lateral edges 7 are folded towards each other (both relative to the rest of the material and over themselves) as illustrated in FIGS. 13 to 15. Each of said lateral portions 16 is folded until they are superposed one on the other at both the first band 11 and the second band 12. In the preferred embodiment, the step of folding the lateral portions 16 of material which are adjacent to the lateral edges 7 comprises folding the material more at the lower edge 6 than at the upper edge 5, in such a way that the container 1 has a cross-section decreasing from the upper edge 5 towards the lower edge 6. In other words, when folding is complete, the container 1 has an overall shape which is roughly that of a truncated cone. That is advantageously achieved by means of a plurality of fold lines 17 which are angled relative to the lateral edges 7, in such a way that they converge with each other towards the lower edge 6.

It should be noticed that the time sequence of the various folding steps may vary according to requirements. Moreover, in other embodiments all of the various folds may be obtained not along fold lines, but by simply bending the material.

The final essential step of the method according to this invention comprises fixing the folded lateral portions 16 in their final positions relative to each other (those illustrated in FIG. 15). While in the embodiment illustrated that is done by gluing, in other embodiments the same result may also be achieved using other methods (for example by slotting or tucking into place suitable elements made in the piece of material 2 in a similar way to that known in the production of three-dimensional objects using folded cardboard, such as making shoe boxes).

Finally, again in this case, once the container 1 is complete, due to the use which will then be made of it, it comprises not just an upper part and a lower part (respectively corresponding to the upper and lower edges), but also a main front face 18 (shown in FIG. 15), a main rear face 19 (the face where the various folded parts are superposed) and two lateral secondary faces 20.

FIGS. 8 to 11 show two possible alternative embodiments of the first method described, while FIGS. 13 and 16 show two alternative embodiments of the second method. However, it should be noticed that all of the alternative embodiments described relative to one method may even be applied to the other method, provided that they are compatible.

Figure 9:
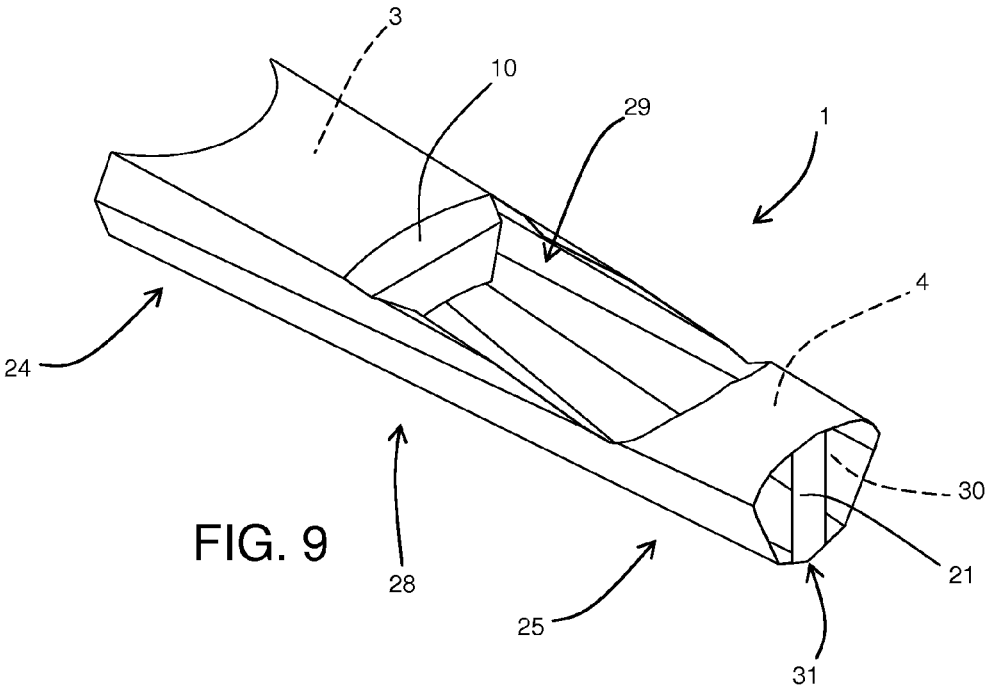
FIG. 9 is a view of an alternative embodiment of the container of FIG. 7 which can be obtained with the piece of material of FIG. 8.

As already indicated, FIGS. 8 and 9 show the case in which the starting piece of material 2 is also created with a projection 8. In this case, the projection 8 must be folded through 90° relative to the rest of the sheet and through 90° over itself to form a bottom element 21 for the second holder 4. The folded outer end of the projection 8 may then be secured between the superposed parts of the two lateral portions 16 of the piece of material 2.

Figure 11:
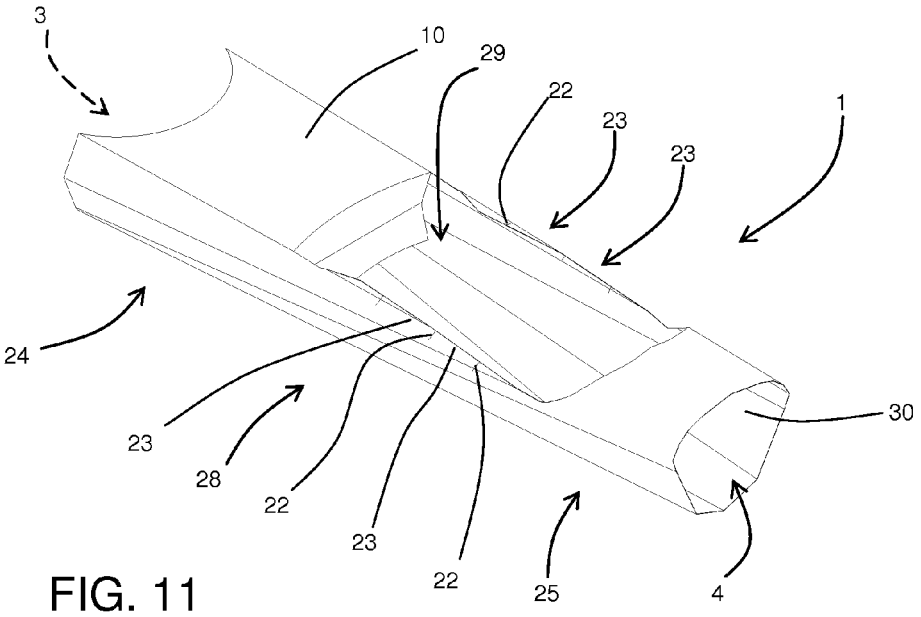
FIG. 11 is a view of a second alternative embodiment of the container of FIG. 7 which can be obtained with the piece of material of FIG. 10.

In contrast, in FIGS. 10 and 11 the only alternative embodiment relating to the method consists of an additional step of making a plurality of small transversal cuts 22 starting from the U-shaped cut 9 and moving outwards. As is explained in more detail below, said cuts identify a set of tabs 23 which in practice can be folded to lock the receptacle in the second holder 4.

As an alternative to use of the tabs 23, the receptacle may also be locked in the second holder by means of a slit 34 formed by two notches 35 made in a specular fashion in the lateral portions 16, as shown in FIG. 12. In fact, the slit 34 is formed by superposing the two notches 35.

In contrast, FIG. 13 shows the case of a container 1 without the slit 34 and other systems for locking the second receptacle.

As illustrated in FIGS. 12 to 16, in other embodiments, the method may also comprise making several small cuts 36 in the piece of material to delimit elements 37 which in the finished container 1 may be folded inwards to support from below a receptacle which is placed in the respective holder 3, 4.

Finally, in the case shown in FIG. 16, the upper edge 5 comprises two projecting parts 32 designed to be superposed on each other in the finished container 1 to form a supporting handle 33. However, in other embodiments handles may also be obtained in other ways.

The above description covers the methods invented by the Applicant for making preferred embodiments of the container 1 according to this invention.

In contrast, the description below provides details of the container 1 itself, which, obviously, depending on requirements may even be made using methods other than those just described.

According to this invention, in general the container 1 comprises a first portion 24 forming a first holder 3 for containing at least one food to be consumed on the move (such as French fries, popcorn, etc.) or for supporting a first receptacle containing a food or a drink to be consumed on the move, and at least a second portion 25 connected to the first portion 24 and forming a second holder 4 for supporting a second receptacle containing a food or a drink. In the embodiment illustrated in FIGS. 1 to 11, the first portion 24 comprises at least a bottom wall 26 and at least a perimetric lateral wall 27 which is coupled to the bottom wall 26, thus together with the latter forming at least the first holder 3. In contrast, in the case of FIGS. 12 to 16, the first holder 3 is formed by the inner part of the ring formed by the first portion 24 and is designed to support only a first receptacle (not the food directly).

Advantageously, in all of the embodiments illustrated the second holder 4 is formed by the inner part of the second portion 25 which is ring-shaped.

According to the inventive aspect of this invention, in the position for use of the container 1, the first holder 3 and the second holder 4 are positioned one at a higher height and one at a lower height and they are distanced from each other in such a way as to allow the user independent access both to the first holder 3 for inserting and removing food or the first receptacle in/from it, and to the second holder 4 for inserting and removing the second receptacle in/from it.

In the preferred embodiment, the first holder 3 is positioned above the second holder 4. However, in other embodiments it is even possible that the first holder 3 is positioned below the second holder 4. In any case, advantageously, in the preferred embodiment the first holder 3 and the second holder 4 are substantially aligned with each other, in such a way that during use the vertical projection of the centre of gravity of one passes through the other.

In the preferred embodiment, the container 1 also comprises at least a third, connecting portion 28 fixed to the first portion 24 and to the second portion 25 and forming at least one opening 29 for access to the lower holder. In particular, in the embodiment illustrated the third portion 28 comprises two lateral shoulders which form a single piece both with the lateral wall of the first portion 24 and with the second portion 25. The opening 29 is also formed by a free space which is present, at the front face 18, between the first portion 24 and the second portion 25.

To facilitate retention of the receptacle, the container 1 advantageously comprises at least first retaining means 30 for retaining from the bottom the receptacle inserted in the first holder 3 or in the second holder 4. In the embodiments illustrated the first retaining means 30 may at least partly comprise the inner part of the ring formed by the second portion 25 as regards the second holder 4 (FIGS. 7 and 15) and the inner part of the ring formed by the first portion 24 as regards the first holder 3 (FIG. 15), the portions 24, 25 being made with a cross-section that decreases downwards. In fact, in this way, with suitable sizing it is possible to guarantee that a traditional receptacle which has the shape of a truncated cone or the like (such as a cup for drinks) is securely wedged in the inner part of the ring.

Moreover, or as an alternative to that, the first retaining means 30 may comprise at least one bottom element 21 mounted in the first holder 3 or in the second holder 4. That embodiment is illustrated for the second holder in FIG. 9, where the bottom element 21 comprises the above-mentioned folded projection 8. The bottom element 21 is particularly advantageous for retaining cylindrical receptacles (such as small plastic bottles) which could otherwise drop through the hole in the bottom of the second holder 4. In contrast, in the case in FIG. 7, in the first holder 3 the effect of the first retaining means 30 is guaranteed by the bottom wall 26.

However, in other embodiments the first retaining means 30 may comprise one or more projecting elements 37 respectively positioned in the first holder 3 (as in FIGS. 12 to 16) or in the second holder 4, and extending cantilever-style towards the inside of the holder 3, 4.

As shown in FIGS. 10 and 11, the container 1 may also comprise second retaining means 31 for retaining from the top a receptacle inserted in the first holder 3 or in the second holder 4 and thus preventing the receptacle from accidentally disengaging from the related holder 4.

In a first preferred embodiment illustrated in FIG. 11, the second retaining means 31 comprise one or more locking tabs 23 able to move between a first position in which they lock a receptacle contained in the second holder 4, preventing its removal (not illustrated), and a second position in which they allow its removal (position illustrated in FIG. 10).

In the case of the embodiment illustrated in FIG. 10, there are two tabs 23 for each side of the container 1 (for different receptacle sizes), delimited by three cuts which are substantially perpendicular to the lateral edge of the piece of material 2 which forms the container 1. The passage of each tab 23 from the second position to the first position occurs when the tab 23 is folded towards the inside of the container 1.

In contrast, in a second embodiment shown in FIG. 15, the second retaining means 31 comprise at least one slit 34 in which an upper part of the receptacle (such as the edge of a cup) can be inserted.

Advantageously, the slit 34 is made at the third, connecting portion 28.

Finally, in other embodiments not illustrated the container may also be provided with other elements such as a supporting handle 33, like the one shown in FIG. 16.

Use of the container 1 according to this invention derives immediately from the above description.

In fact, in practice, the container 1 is positioned substantially vertically (with the lower edge 6 downwards) and the food or the first receptacle is inserted in the first holder 3. If the user is also holding a second receptacle (for example for a drink, such as a cup or a small bottle), he can insert it in the second holder 4 from above (in the embodiment illustrated through the free space defined by the third portion 28).

At that point the user can hold any part of the container 1 with one hand, while using his other hand for drinking or eating. If a receptacle for a drink has a straw inserted in it, the user can drink from it without removing the receptacle from the second holder 4, since the straw can be made to project outwards at the front opening 29.

If a container 1 made of semi-rigid material such as cardboard is used, it should be noticed that if the receptacle has the shape of a truncated cone or the like, when it is inserted in the related holder 3, 4, its weight allows it to deform the respective portion 24, 25 transforming the ring with polygonal cross-section into a ring with a cross-section that is practically circular or shaped to match its own. Depending on the dimensions, in the case of the container 1 of FIG. 7 or 15, the receptacle partly comes out of the second portion 25 in a downward direction.

This invention brings important advantages.

First, the container according to this invention on one hand allows two items (food and/or drinks) to be held separately, and on the other hand is absolutely simpler to support than the prior art containers. In fact, it is sufficient to support the upper portion of the container by gripping it normally, to also hold the lower portion. Moreover, the container can easily by supported either with a bent arm (typical position at the time of drinking or picking up food) or with an arm extended along the body. In fact, since the container can be gripped higher up than its centre of gravity, it is practically impossible to accidentally spill the contents, because the force of gravity always tends to keep the container vertical, that is to say, in the position intended for its use.

Moreover, the container according to this invention can easily be made even from a single sheet of folded material, meaning that it is definitely inexpensive and so can be used without problems even as a disposable item.

Finally, it should be noticed that this invention is relatively easy to produce and that even the cost linked to implementing the invention is not very high.

The invention described above may be modified and adapted in several ways without thereby departing from the scope of the inventive concept.

Moreover, all details of the invention may be substituted with other technically equivalent elements and the materials used, as well as the shapes and dimensions of the various components, may vary according to requirements.

The invention claimed is:

1. A container for food and/or drink to be consumed on the move, comprising:

a first portion (24) forming at least a first holder (3) for containing at least one food to be consumed on the move or for supporting a first receptacle containing a food or a drink to be consumed on the move;

at least a second portion (25) connected to the first portion (24) and forming at least a second holder (4) for supporting a second receptacle containing at least one food or a drink to be consumed on the move; and at least one third connecting portion (28) fixed to the first portion (24) and to the second portion (25);

characterised in that, in the position for use of the container (1), the first holder (3) and the second holder (4) are positioned one at a higher height and one at a lower height, the first holder (3) and the second holder (4) being distanced from each other along a front face (18) of the container (1) by said at least one third connection portion (28), in such a way as to allow the user independent access both to the first holder (3) for inserting food in and removing food from the first holder (3) or respectively inserting and removing the first receptacle, and to the second holder (4) for inserting and removing the second receptacle in/from the second holder (4), and also being characterised in that said at least one third connecting portion (28) forms at least one opening (29) for access from above to the lower holder, said at least one opening (29) being a front opening which is formed by a free space at the front face (18), between the first portion (24) and the second portion (25).

2. The container for food and/or drink to be consumed on the move according to claim 1, characterised in that the first holder (3) is positioned above the second holder (4), and also being characterised in that the second portion (25) has the shape of a ring, and in that the second holder (4) is formed by the inner part of that ring.

3. The container for food and/or drink to be consumed on the move according to claim 1, characterised in that the first holder (3) is positioned above the second holder (4), and also being characterised in that the first portion (24) has the shape of a ring, and in that the first holder (3) is formed by the inner part of that ring and is designed to support only a first receptacle.

4. The container for food and/or drink to be consumed on the move according to claim 1, characterised in that the container also comprises at least first retaining means (30) for retaining from the bottom a receptacle placed in the first holder (3) or in the second holder (4).

5. The container for food and/or drink to be consumed on the move according to claim 4, characterised in that the first holder (3) is positioned above the second holder (4), in that:

the second portion (25) has the shape of a ring, and the second holder (4) is formed by the inner part of that ring; and/or the first portion (24) has the shape of a ring, and the first holder (3) is formed by the inner part of that ring and is designed to support only a first receptacle;

and in that the inner part of the ring formed respectively by the second portion (25) or by the first portion (24) has a cross-section which decreases downwards, therefore forming the first retaining means (30).

6. The container for food and/or drink to be consumed on the move according to claim 4, characterised in that the first retaining means (30) comprise at least one bottom element (21) mounted respectively in the first holder (3) or in the second holder (4).

7. The container for food and/or drink to be consumed on the move according to claim 4, characterised in that the first retaining means (30) comprise one or more projecting elements (37) respectively positioned in the first holder (3) or in the second holder (4) and extending cantilever-style towards the inside of the holder (3), (4).

8. The container for food and/or drink to be consumed on the move according to claim 1, characterised in that the container also comprises retaining means (31) for retaining from the top a receptacle inserted in the first holder (3) or in the second holder (4).

9. The container for food and/or drink to be consumed on the move according to claim 8, characterised in that the retaining means (31) comprise one or more locking tabs (23) able to move between a first position in which they lock the receptacle, preventing its removal, and a second position in which they allow its removal.

10. The container for food and/or drink to be consumed on the move according to claim 9, characterised in that the retaining means (31) comprise at least one slit (34) in which an upper part of the receptacle can be inserted.

11. The container for food and/or drink to be consumed on the move according to claim 1, characterised in that the first holder (3) and the second holder (4) are substantially aligned with each other.

12. The container for food and/or drink to be consumed on the move according to claim 1, characterised in that the first portion (24) comprises at least a bottom wall (26) and at least a perimetric lateral wall (27) which is coupled to the bottom wall (26), thus together with the latter forming at least the first holder (3).

13. The container for food and/or drink to be consumed on the move according to claim 1, characterised in that the container also comprises a supporting handle (33).

14. The container for food and/or drink to be consumed on the move according to claim 1, characterised in that the container is made of a single piece of substantially flat rigid or semi-rigid material (2) which is folded and glued or fixed over itself.

15. The container for food and/or drink to be consumed on the move according to claim 2, characterised in that the container is made of a single piece of substantially flat rigid or semi-rigid material (2) which is folded and glued or fixed over itself.

16. The container for food and/or drink to be consumed on the move according to claim 3, characterised in that the container is made of a single piece of substantially flat rigid or semi-rigid material (2) which is folded and glued or fixed over itself.

17. The container for food and/or drink to be consumed on the move according to claim 11, characterised in that the container is made of a single piece of substantially flat rigid or semi-rigid material (2) which is folded and glued or fixed over itself.

18. The container for food and/or drink to be consumed on the move according to claim 14, characterized in that the first holder (3) is positioned above the second holder (4) and in that the first holder (3) has a bottom which is formed by a folded flap (10), the folded flap (10) being a mainly U-shaped cut portion (9) of the single piece of substantially flat rigid or semi-rigid material (2), the mainly U-shaped cut portion (9) being connected to the remaining material at an upper part of the U-shaped cut and being folded towards an upper edge (5) of the container.

19. The container for food and/or drink to be consumed on the move according to claim 14, characterised in that said at least one opening (29) is made in a central zone of the single piece of substantially flat rigid or semi-rigid material (2).

20. A method for making a container (1) for food and/or drink to be consumed on the move comprising a first holder (3) for containing at least one food to be consumed on the move and at least a second holder (4) for supporting a receptacle containing a drink, wherein, in the position for use of the container (1), the first holder (3) and the second holder (4) are positioned one above the other and one below the other and they are distanced from each other in such a way as to allow the user independent access both to the first holder (3) for inserting food in and removing food from the first holder (3) and to the second holder (4) for inserting and removing the second receptacle in/from the second holder (4), characterised in that the method comprises the operating steps of:

taking a piece of flat rigid or semi-rigid material (2) comprising an upper edge (5), a lower edge (6) and two lateral edges (7);

making a mainly U-shaped cut (9) in the piece of material (2) for delimiting in the material a flap of material (10) connected to the remaining material, the orientation of the cut (9) being such that the upper part of the U is towards the upper edge (5);

folding the flap of material (10) at least relative to the remaining material towards the upper edge (5), until the flap of material is positioned at least substantially partly opposite and distanced from the portion of material lying between the flap of material (10) and the upper edge (5);

folding the lateral portions (16) of material adjacent to the lateral edges (7) towards each other until they are both at least partly superposed on the folded flap of material (10), and on each other at least at the lower edge (6); and fixing the flap of material (10) and the other folded lateral portions (16) in position.

21. The method according to claim 20, characterised in that the step of folding the lateral portions (16) of material adjacent to the lateral edges (7) comprises folding the material more at the lower edge (6) than at the upper edge (5), in such a way that the container (1) has a cross-section decreasing from the upper edge (5) towards the lower edge (6).

22. A method for making a container (1) for food and/or drink to be consumed on the move comprising a first holder (3) for supporting a first receptacle and at least a second holder (4) for supporting a second receptacle, wherein, in the position for use of the container (1), the first holder (3) and the second holder (4) are positioned one above the other and one below the other and they are distanced from each other in such a way as to allow the user independent access both to the first holder (3) for inserting and removing the first receptacle and to the second holder (4) for inserting and removing the second receptacle in/from the second holder (4), characterised in that the method comprises the operating steps of:

taking a piece of flat rigid or semi-rigid material (2) comprising an upper edge (5), a tower edge (6) and two lateral edges (7);

making a through opening (29) in a central zone of the piece of material (2);

folding the lateral portions (16) of material adjacent to the lateral edges (7) towards each other until they are both at least partly superposed at the lower edge (6) and the upper edge (5); and fixing the folded lateral portions (16) in position;

the step of folding the lateral portions (16) of material adjacent to the lateral edges (7) comprising folding the material more at the lower edge (6) than at the upper edge (5), in such a way that the container (1) has a cross-section decreasing from the upper edge (5) towards the lower edge (8).

* * * * *

UNITED STATES PATENT AND TRADEMARK OFFICE

CERTIFICATE OF CORRECTION

PATENT NO. : 9,033,211 B2
APPLICATION NO. : 14/001445
DATED : May 19, 2015
INVENTOR(S) : Roberto Zanini It is certified that error appears in the above-identified patent and that said Letters Patent is hereby corrected as shown below:

Claims

Column 12, line 58, Claim 22, delete "(8)" and insert therefor -- (6) --.

Signed and Sealed this
Twenty-second Day of September, 2015

Michelle K. Lee

Michelle K. Lee
*Director of the United States Patent and Trademark Office*